US011201384B2

(12) United States Patent
Ge et al.

(10) Patent No.: US 11,201,384 B2
(45) Date of Patent: Dec. 14, 2021

(54) METHODS AND APPARATUS FOR THE MOUNTING OF ANTENNA APPARATUS

(71) Applicant: Pulse Finland OY, Oulunsalo (FI)

(72) Inventors: Zack Ge, Suzhou (CN); Jay Yuan, Siqian (CN)

(73) Assignee: Pulse Finland OY, Oulunsalo (FI)

( * ) Notice: Subject to any disclaimer, the term of this patent is extended or adjusted under 35 U.S.C. 154(b) by 207 days.

(21) Appl. No.: 16/241,686

(22) Filed: Jan. 7, 2019

(65) Prior Publication Data

US 2019/0237845 A1 Aug. 1, 2019

Related U.S. Application Data

(60) Provisional application No. 62/622,660, filed on Jan. 26, 2018.

(51) Int. Cl.

| | |
|---|---|
| ***H01Q 1/00*** | (2006.01) |
| ***H01Q 1/12*** | (2006.01) |
| ***H01Q 1/42*** | (2006.01) |
| ***H01Q 1/48*** | (2006.01) |
| ***H01Q 9/32*** | (2006.01) |

(52) U.S. Cl.

CPC ..... *H01Q 1/1214* (2013.01); *H01Q 1/007* (2013.01); *H01Q 1/42* (2013.01); *H01Q 1/48* (2013.01); *H01Q 9/32* (2013.01)

(58) Field of Classification Search

CPC ..... H01Q 1/007; H01Q 1/08; H01Q 1/085; H01Q 1/1207; H01Q 1/1214; H01Q 1/1235; H01Q 1/20; H01Q 1/325; H01Q 1/3275; H01Q 1/3291; H01Q 1/42; H01Q 1/48; H01Q 9/32; H01Q 9/34; H01Q 9/38

See application file for complete search history.

(56) References Cited

U.S. PATENT DOCUMENTS 4,115,783 A * 9/1978 Reggia ..... H01Q 1/08 343/792

5,707,723 A 1/1998 Harrison et al.

(Continued)

FOREIGN PATENT DOCUMENTS

| | | | |
|---|---|---|---|
| CN | 2729929 | Y | 9/2005 |
| CN | 101401256 | A | 4/2009 |
| CN | 102709673 | A | 10/2012 |

*Primary Examiner* — Dimary S Lopez Cruz
*Assistant Examiner* — Patrick R Holecek
(74) *Attorney, Agent, or Firm* — Gazdzinski & Associates, PC

(57) ABSTRACT

In-building antenna apparatus and methods for manufacturing and installing the same. In one embodiment, the antenna apparatus includes a radome cover, a lower flange, an antenna housing, a spring-loaded mount apparatus, a signaling interface, and a plurality of spring arms. Each of the spring arms may include at least one tie-down location. Accordingly, when a removable tie is placed around a plurality of tie-down locations, the antenna apparatus resides in an installation configuration; however, when the removable tie is removed from around the plurality of tie-down locations, the antenna apparatus transitions towards a default configuration. The spring arms may also act as a ground plane for the antenna. Spring-loaded mount apparatus as well as methods of manufacturing and installing the aforementioned antenna apparatus are also disclosed.

20 Claims, 12 Drawing Sheets

(56) References Cited

U.S. PATENT DOCUMENTS

| | | | | |
|---|---|---|---|---|
| 6,236,377 | B1 * | 5/2001 | Hussaini | H01Q 1/1207 343/715 |
| 6,452,549 | B1 | 9/2002 | Lo | |
| 8,988,298 | B1 | 3/2015 | Akhoondzadehasl et al. | |
| 9,209,526 | B2 | 12/2015 | Gao et al. | |
| 9,722,308 | B2 | 8/2017 | Emerick et al. | |
| 9,917,375 | B2 | 3/2018 | Korva et al. | |
| 2010/0220016 | A1 | 9/2010 | Nissinen et al. | |
| 2013/0285879 | A1 | 10/2013 | Wheeler | |

* cited by examiner

METHODS AND APPARATUS FOR THE MOUNTING OF ANTENNA APPARATUS

PRIORITY

This application claims the benefit of priority to U.S. Provisional Patent Application Ser. No. 62/622,660 of the same title, filed Jan. 26, 2018, the contents of which being incorporated by reference herein in its entirety.

RELATED APPLICATIONS

This application is related to co-owned and co-pending U.S. patent application Ser. No. 14/472,170 entitled "Low Passive Intermodulation Distributed Antenna System for Multiple-Input Multiple-Output Systems and Methods of Use", filed Aug. 28, 2014, and co-owned and co-pending U.S. patent application Ser. No. 14/964,374 entitled "Broadband Omni-Directional Dual-Polarized Antenna Apparatus and Method of Manufacturing and Use", filed Dec. 9, 2015, each of the foregoing being incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. TECHNOLOGICAL FIELD

The present disclosure relates generally to antenna solutions, and more particularly in one exemplary aspect to antenna solutions for use in, for example, installations within buildings or other structures or venues.

2. DESCRIPTION OF RELATED TECHNOLOGY

Antennas in wireless communication networks are critical devices for both transmitting and receiving wireless signals. With the evolution of network communication technology migrating from less to more capable technology; e.g., third generation systems ("3G") to fourth generation systems ("4G") and now fifth generation systems ("5G"), higher-bandwidth WLAN (e.g., Wi-Fi) systems replacing earlier variants, etc., the need for antennas which can clearly receive fundamental frequencies or signals with minimal distortion are becoming more critical. Additionally, with consumers switching to a lifestyle of near constant Internet connection, the demand on these wireless networks has increased dramatically. As a result, wireless networks have prioritized capacity demands which have often times come at the expense of wireless coverage. One such proposed solution to the foregoing problem has been to bring these wireless networks closer to the consumer. The Assignee of the present application has sought to provide antenna solutions for use in, for example, in-building environments.

Exemplary antenna solutions for such applications are described in co-owned and co-pending U.S. patent application Ser. No. 14/472,170 entitled "Low Passive Intermodulation Distributed Antenna System for Multiple-Input Multiple-Output Systems and Methods of Use", filed Aug. 28, 2014, and co-owned and co-pending U.S. patent application Ser. No. 14/964,374 entitled "Broadband Omni-Directional Dual-Polarized Antenna Apparatus and Method of Manufacturing and Use", filed Dec. 9, 2015, each of the foregoing being previously incorporated herein by reference in its entirety.

However, antennas such as those described in the aforementioned U.S. patent applications may be difficult to install in certain cases, thereby introducing an obstacle to their more widespread adoption. For example, many such antenna solutions require the ceiling tile in a building to be removed, a hole to be drilled into the aforementioned ceiling tile, and the securing of the antenna to the ceiling tile using, for example, a nut with a large washer to protect against damaging the ceiling tile during the installation process (and to support the antenna during subsequent operation).

Accordingly, there is a need for apparatus, systems and methods that provide for more convenient antenna installations in, for example, in-building or other structural environments. Additionally, such solutions should ideally reduce changes needed to support antenna installation, as well as minimize the possibility of damaging the components to which these antennae are installed.

Moreover, such solutions would ideally improve upon antenna operating performance, e.g., improve or maintain antenna isolation between operating bands while providing a minimal level of distortion to the radiation pattern (thereby making the antenna operate in a more omni-directional manner).

SUMMARY

The aforementioned needs are satisfied herein by providing antenna apparatus, systems and methods that provide for, inter alia, simple and more convenient antenna installation in, for example, in-building environments, while simultaneously providing for desirable operational characteristics (e.g., wider operating bandwidth, polarization and/or spatial diversity), and which also meet one or more aesthetic design goals (e.g., a radome form-factor that is less spatially intrusive, requires no aesthetic customization prior to installation, etc.).

In one aspect, an antenna apparatus is disclosed. In one embodiment, the antenna apparatus includes a radome or cover element; a lower flange disposed adjacent to the radome; an antenna housing, the lower flange being disposed between the radome and the antenna housing; a signaling interface; and a spring-loaded mount apparatus. The spring-loaded mount apparatus includes: a housing, a plurality of torsion springs located in or on the housing; and a plurality of spring arms, each of the plurality of spring arms being coupled with one or more of the plurality of torsion springs.

In one variant, the spring-loaded mount apparatus serves both a mechanical and an electrical function.

In another variant, the electrical function includes serving as a ground plane for the antenna apparatus.

In yet another variant, the plurality of spring arms each includes a plurality of undulations, the plurality of undulations increasing an electrical length for the ground plane as compared with a spring arm that does not include the plurality of undulations.

In yet another variant, the plurality of torsion springs are configured to place the plurality of spring arms against the lower flange.

In yet another variant, the plurality of spring arms each include at least one tie down location, the tie down locations configured to be used with a tie down in order to place the spring-loaded mount apparatus into an installation configuration.

In yet another variant, the antenna apparatus further includes a quarter wave monopole antenna, the quarter wave monopole antenna being disposed within the radome cover.

In yet another variant, the ground plane for the antenna apparatus is configured such that a radiating pattern for the quarter wave monopole antenna is omnidirectional in nature, the radiating pattern being further directed away from the ground plane of the antenna apparatus.

In another aspect, a spring-loaded mount apparatus is disclosed. In one embodiment, the spring-loaded mount apparatus includes: a housing having a plurality of torsion springs located in or on the housing; and a plurality of spring arms, each of the plurality of spring arms being coupled with one or more of the plurality of torsion springs.

In a variant, the spring-loaded mount apparatus is activated via removal of one or more removable ties.

In another variant, the spring-loaded mount apparatus is activated via physical actuation, the physical actuation including a switch apparatus.

In yet another variant, the spring-loaded mount apparatus is activated via use of an electromechanical actuation apparatus.

In yet another aspect, a method of manufacturing the aforementioned antenna apparatus is disclosed.

In yet another aspect, a method of manufacturing the aforementioned spring-loaded mount apparatus is disclosed.

In yet another aspect, a method of installing the aforementioned antenna apparatus is disclosed. In one embodiment, the method includes drilling or cutting an installation hole into a structure; routing a cable assembly through the installation hole; assembling the cable assembly to the antenna apparatus; partially inserting the antenna apparatus into the installation hole, the partially inserted antenna apparatus being in an installation configuration; actuating spring-retention arms on the antenna apparatus, thereby causing the antenna apparatus to transition into a default configuration; and fully inserting the antenna apparatus into the installation hole.

Various objects, features, aspects and advantages of the inventive subject matter will become more apparent from the following detailed description of exemplary embodiments, along with the accompanying drawings.

BRIEF DESCRIPTION OF THE DRAWINGS

The features, objectives, and advantages of the disclosure will become more apparent from the detailed description set forth below when taken in conjunction with the drawings, wherein.

DETAILED DESCRIPTION

Figure 1:
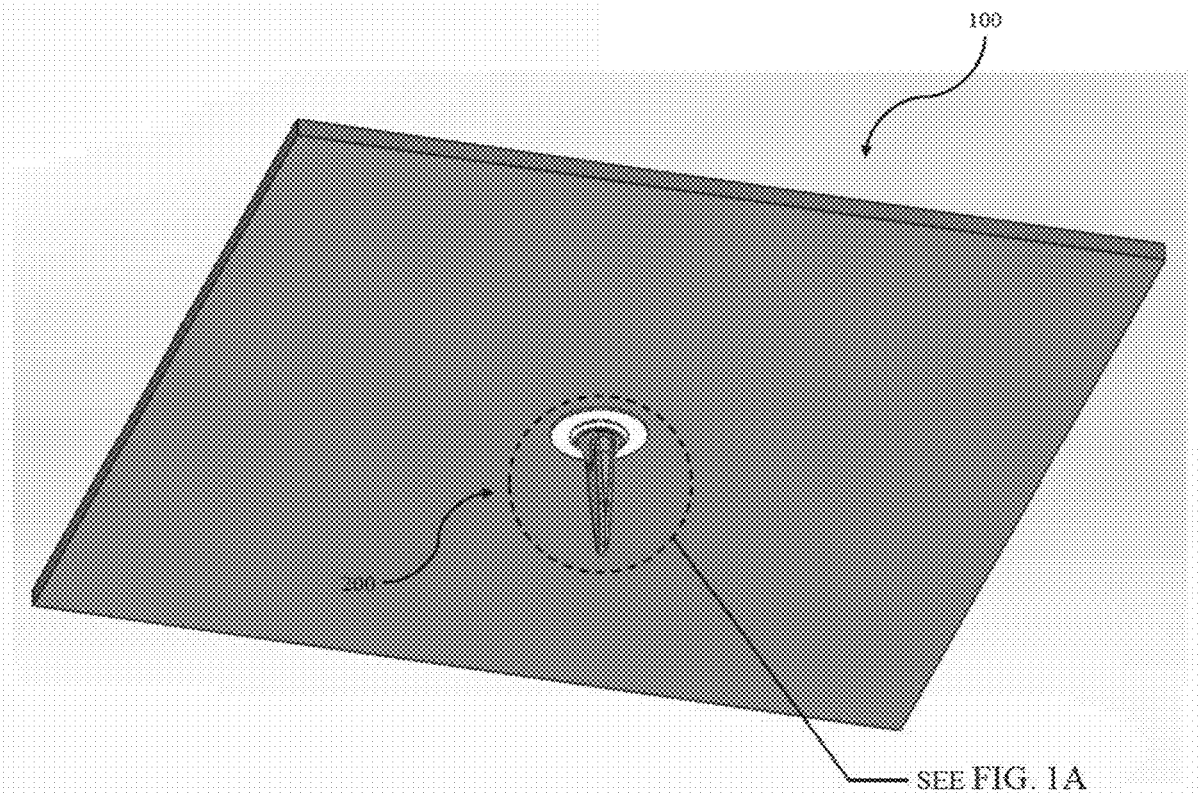
FIG. 1 is a perspective view of one embodiment of an antenna apparatus mounted within a ceiling tile in accordance with the principles of the present disclosure.

Reference is now made to the drawings wherein like numerals refer to like parts throughout.

As used herein, the term "antenna" refers without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, one or more repeater links, and one or more locations may be mobile, stationary, or fixed to a location on earth such as a base station.

As used herein, the term "feed" refers without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the term "radiator" refers generally and without limitation to an element that can function as part of a system that receives and/or transmits radio-frequency electromagnetic radiation; e.g., an antenna.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a ceiling tile).

As used herein, the term "wireless" means any wireless signal, data, communication, or other interface including without limitation Wi-Fi (e.g., IEEE Std. 802.11 a/b/g/n/v/as), Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, Zigbee, Near field communication (NFC)/RFID, CDPD, satellite systems such as GPS and GLONASS, and millimeter wave or microwave systems.

Exemplary Embodiments

Detailed descriptions of the various embodiments and variants of the apparatus and methods of the present disclosure are now provided. While primarily discussed in the context of a ceiling tile installation procedure for the installation of the antenna apparatus as described herein, it is not necessarily a prerequisite that the antenna embodiments described herein are mounted within a ceiling. For example, it is appreciated that variants of the antenna apparatus described herein could be suitable for installation in, for example, walls (e.g., removable wall tiles, drywall and/or other types of wall structures), floors, utility boxes (whether indoor or outdoor), transportation vehicles (e.g., buses, aerial vehicles, nautical vehicles among others), or other suitable mounting structures and the like. These and other variants would be readily apparent to one of ordinary skill given the contents of the present disclosure.

Moreover, while primarily discussed in the context of use with a low profile quarter wave monopole antenna such as, for example, the ICEFIN series of antennas manufactured by the Assignee hereof, the present disclosure has broad applicability to any number of differing antenna designs and antenna solutions. For example, the principles of the present disclosure including, for example, the spring-loaded mount design may equally be applied to the in-building broadband omni-directional dual-polarized multiple-in multiple-out (MIMO) antenna apparatus described in co-owned and co-pending U.S. patent application Ser. No. 14/964,374 entitled "Broadband Omni-Directional Dual-Polarized Antenna Apparatus and Method of Manufacturing and Use", filed Dec. 9, 2015, as well as the MIMO antenna described in co-owned and co-pending U.S. patent application Ser. No. 14/472,170 entitled "Low Passive Intermodulation Distributed Antenna System for Multiple-Input Multiple-Output Systems and Methods of Use", filed Aug. 28, 2014, each of the foregoing being previously incorporated herein by reference in its entirety.

Exemplary Antenna Apparatus—

Figure 1A:
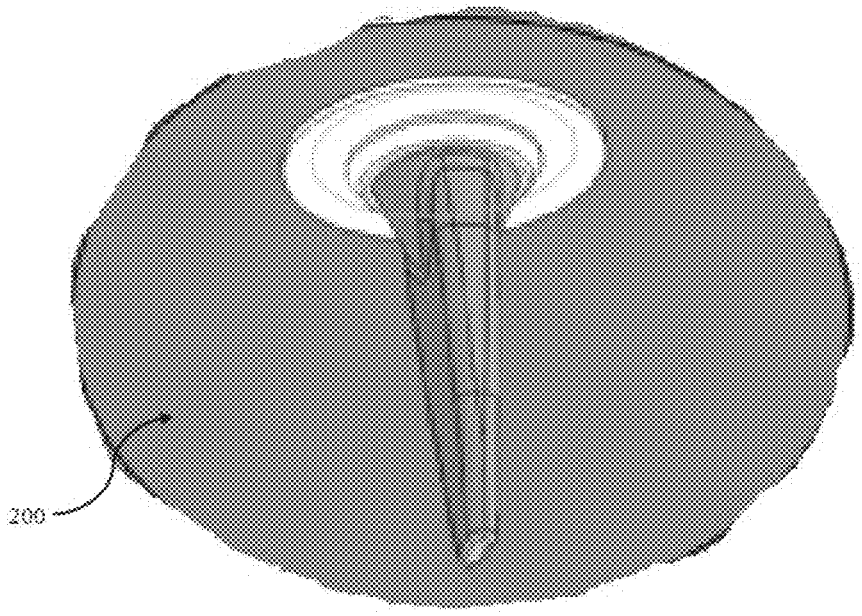
FIG. 1A is a detailed perspective view of the antenna apparatus of FIG. 1, manufactured in accordance with the principles of the present disclosure.

Referring now to FIGS. 1 and 1A, one embodiment of an antenna apparatus 200 mounted within a ceiling tile 100 is shown. The antenna apparatus 200 may be utilized in a number of differing wireless networks and for a number of differing wireless applications including models that support, for example, land mobile radio (LMR) networks currently utilized by first responders or other public safety personnel. For example, these LMR networks may consist of two way radios for use by first responder organizations such as, for example, police, fire, and ambulance personnel. The antenna apparatus 200 may also be utilized in wireless networks such as public works organizations including, for example, municipal buildings, schools, and hospitals; transport infrastructure (e.g., bus, rail, air, passenger ship and/or other forms of transit); public spaces (e.g., concert halls, sporting stadiums and the like) and/or other physical assets and facilities. The antenna apparatus 200 may operate according to a variety of wireless standards including, without limitation, any one or more of the aforementioned wireless standards described supra. For example, the antenna apparatus 200 may be utilized for dedicated short-range communications (DSRC) as but one non-limiting example.

In another significant use case, the antenna apparatus 200 may be used in Internet of Things (IoT) applications including in, for example, vending, metering, and/or other industrial applications. As a brief aside, IoT devices can use any number of lower- and higher-layer protocol stacks. Many are based on the IEEE Std. 802.15.4 WPAN MAC/PHY (including ZigBee and Thread), while others utilize BLE (Bluetooth Low Energy, also referred to colloquially as Bluetooth Smart). These technologies utilize unlicensed portions of the radio frequency spectrum (e.g., ISM bands in the U.S.) for communication, and may attempt to avoid interference or conflict with other ISM-band technologies such as Wi-Fi (IEEE Std. 802.11). Currently, the following non-exhaustive list of exemplary technologies are available for IoT applications:

ZigBee—

ZigBee 3.0 is based on IEEE Std. 802.15.4, and operates at a nominal frequency of 2.4 GHz as well as 868 and 915 MHz (ISM), supports data rates on the order of 250 kbps, and has a range on the order of 10-100 meters. ZigBee radios use direct-sequence spread spectrum (DSSS) spectral access/coding, and binary phase-shift keying (BPSK) is used in the 868 and 915 MHz bands, and offset quadrature phase-shift keying (OQPSK) that transmits two bits per symbol is used for the 2.4 GHz band.

Z-Wave—

Z-Wave technology is specified by the Z-Wave Alliance Standard ZAD12837 and ITU-T G.9959 (for PHY and MAC layers). It operates in the U.S. at a nominal frequency of 900 MHz (ISM). Z-Wave has a range on the order of 30 meters, and supports full mesh networks without the need for a coordinator node (as in 802.15.4). It is scalable, enabling control of up to 232 devices. Z-Wave uses a simpler protocol than some others, which can ostensibly enable faster and simpler development. Z-Wave also supports AES128 encryption and IPv6.

6LowPAN—

6LowPAN (IPv6 Low-power wireless Personal Area Network) is an IP-based network protocol technology (rather than an IoT application protocol technology such as Bluetooth or ZigBee), as set forth in RFC 6282. 6LowPAN defines encapsulation and header compression mechanisms, and is not tied to any particular PHY configuration. It can also be used along with multiple communications platforms, including Ethernet, Wi-Fi, 802.15.4 and sub-1 GHz ISM. The IPv6 (Internet Protocol version 6) stack enables embedded objects or devices to have their own unique IP address, and connect to the Internet. IPv6 provides a basic transport mechanism to e.g., enable complex control systems, and to communicate with devices via a low-power wireless network.

Thread—

Thread is a royalty-free protocol based on various standards including IEEE Std. 802.15.4 (as the air-interface protocol) and 6LoWPAN. It is intended to offer an IP-based solution for IoT applications, and is designed to interoperate with existing IEEE Std. 802.15.4-compliant wireless silicon. Thread supports mesh networking using IEEE Std. 802.15.4 radio transceivers, and can handle numerous nodes, including use of authentication and encryption.

Bluetooth Smart/BLE—

Bluetooth Smart or BLE is intended to provide considerably reduced power consumption and cost while maintaining a similar communication range to that of conventional Bluetooth radios. Devices that employ Bluetooth Smart features incorporate the Bluetooth Core Specification Version 4.0 (or higher—e.g., Version 4.2 announced in late 2014) with a combined basic-data-rate and low-energy core configuration for a RF transceiver, baseband and protocol stack. Version 4.2, via its Internet Protocol Support Profile, allows Bluetooth Smart sensors to access the Internet directly via 6LoWPAN connectivity (discussed supra). This IP connectivity enables use of existing IP infrastructure to manage Bluetooth Smart "edge" devices. In 2017, the Bluetooth SIG released Mesh Profile and Mesh Model specifications, which enable using Smart for many-to-many device communications. Moreover, many mobile operating systems including 10S, Android, Windows Phone, BlackBerry, and Linux, natively support Bluetooth Smart.

The Bluetooth 4.2 Core Specification specifies a frequency of 2.4 GHz (ISM band), supports data rates on the order of 1 Mbps, utilizes GFSK (Gaussian Frequency Shift Keying) modulation, and has a typical range on the order of 50 to 150 meters. BLE uses frequency hopping (FHSS) over 37 channels for (bidirectional) communication, and over 3 channels for (unidirectional) advertising. The Bluetooth 4.0 link-layer MTU is 27 bytes, while 4.2 used 251 bytes. Core specification 5.0 (adopted Dec. 6, 2016) yet further extends and improves upon features of the v4.2 specification.

Notably, the antenna apparatus 200 of the present disclosure may also consist of a multi-band antenna (e.g., operating in the frequency bands of two or more of 608-960 MHz, 1695-2200 MHz, 2300-2700 MHz, and 4900-5900 MHz, as but one non-limiting example). These multiple bands may be associated with a common air interface protocol, or two or more different air interface protocols.

Figure 2:
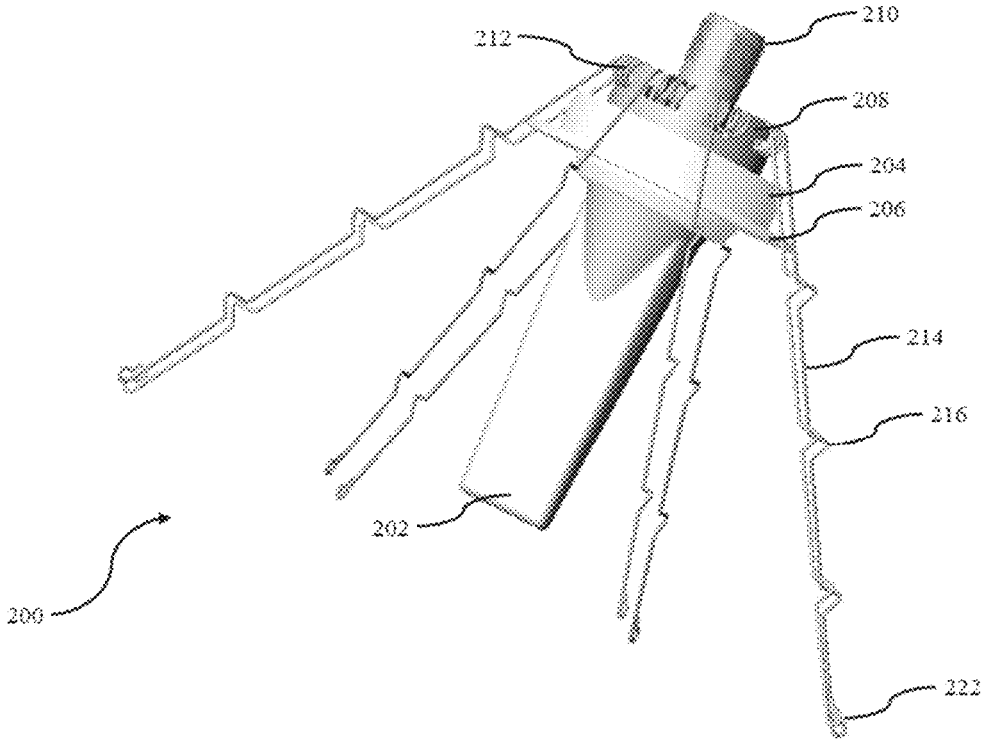
FIG. 2 is a perspective view of the antenna apparatus of FIG. 1 shown in its default configuration in accordance with the principles of the present disclosure.

Referring now to FIG. 2, one embodiment of the antenna apparatus 200 is shown removed from the ceiling tile 100 of, for example, FIGS. 1 and 1A. The antenna apparatus 200 may include a radome or cover 202. The radome/cover 202 material may be selected from any number of suitable materials including, for example, polymer-based materials. In some implementations, the radome cover 202 may be manufactured from a transparent (clear) visually appealing plastic, although the types of material as well as colors for the radome/cover may be selected from a nearly limitless number of known possibilities. The antenna apparatus may also include a lower flange 206 that may be formed adjacent to the antenna housing 204. In some implementations, the lower flange 206 and antenna housing 204 may be formed from a unitary piece of material including, for example, the aforementioned polymer-based materials, metallic materials, or combinations of the foregoing. The lower flange 206 (including the antenna housing 204 in some implementations) may be adapted to weatherproof the antenna apparatus 200. Such weatherproofing may be desirable in, for example, outdoor wireless applications. For example, the weatherproofing may include a gasket or seal that is disposed between, for example, the lower flange 206 and housing 204. While the use of a gasket or seal is exemplary, it would be readily appreciated by one of ordinary skill given the contents of the present disclosure that other forms of weatherproofing may be utilized so as to hermetically seal the internal electronics present within the antenna apparatus 200.

It will also be appreciated that the radome/cover 202 may also be heterogeneous in its construction; e.g., with two or more materials utilized in portions of its structure. For instance, in one variant, the radome/cover may be segmented along a longitudinal plane of the apparatus, such that different materials (or compositions/blends of a common general material) may be used on one half of the radome/cover versus the other. As such, the radome/cover may also be comprised of two or more component or constituent pieces, such as to facilitate such use of heterogeneous construction or materials, or for other purposes. Use of heterogeneous materials or portions of the radome cover may also allow for differential radio frequency energy propagation characteristics, such as e.g., shaping the radiated emissions from the antenna apparatus during operation.

The antenna apparatus 200 may also include a spring-loaded or otherwise biased mount apparatus 208. The spring-loaded mount apparatus 208 is shown in its unconstrained/default configuration with the arms 214 of the spring-loaded mount apparatus 208 being kept, for example, under tension against the lower flange 206. The spring-loaded mount arms 214 may further include tie-down locations 216, with these tie-down locations 216 also acting to provide additional rigidity to the spring-loaded mount arms 214. The end features 222 may include curved surfaces (as illustrated) in order to prevent damage to the item (e.g., the ceiling tile or other mounting surface) to which the antenna apparatus 200 is ultimately to be mounted during installation (as well as once the antenna apparatus 200 is installed). In some implementations, the end features 222 may include coverings (e.g., that are made of rubber or other relatively soft material(s)) in order to prevent, for example, the aforementioned damage during/after installation. The spring-loaded mount arms 214 may also be made from a conductive material in some implementations so that the arms 214 may then act as, for example, a ground plane for the antenna apparatus 200 (e.g., a ground plane for a quarter wave monopole antenna radiator, as but one non-limiting example). Herein lies another salient advantage of the antenna apparatus described herein, namely the ability for the spring-loaded mount arms 214 to serve both mechanical and electrical functions. For example, in the context of monopole-type antenna radiators, these types of radiators may only function adequately when electrically coupled with a suitable ground structure (e.g., the spring-loaded mount arms 214).

The length, shape as well as the number of spring-loaded mount arms 214 may all be adjusted in order to manipulate the size of the ground plane as well as to manipulate the radiation pattern characteristics of the antenna. For example, the added length resultant from the undulating shape of the tie-down locations 216 as well as the curved end features 222 result in the selected radiation pattern characteristics for the exemplary antenna apparatus 200 of FIG. 2. The length of the spring-loaded mount arms 214 was selected such that when the antenna apparatus 200 is installed, the antenna gain pattern for the antenna apparatus 200 is directed downwards (e.g., in a vertical direction towards the floor) with an omnidirectional radiating pattern in a horizontal direction (e.g., in a plane parallel to the ceiling). Such a radiating pattern is advantageous as the radiating pattern above the ceiling tiles is minimized, thereby preventing and/or minimizing interference with other possible radiators/antennas located on, for example, upper floors of a multi-floor building. Additionally, the antenna apparatus 200 of FIG. 2 minimizes the amount of energy directly underneath the antenna in order to, for example, reduce the amount of interference caused by reflections from the floor below the antenna apparatus 200. In other words, the length, shape and number of spring-loaded mount arms 214 in the embodiment illustrated in FIG. 2 have all been selected for advantageous use in multi-floor buildings. These and other variants would be readily apparent to one of ordinary skill given the contents of the present disclosure.

The spring-loaded nature of the arms 214 may be accomplished via the incorporation of torsion springs 212 located within, for example, the spring-loaded mount apparatus 208. In some implementations, such as that shown in FIG. 2B, the arms may be "locked" in its installation configuration via the use of removable ties 218. These removable ties 218 may be placed in, for example, one or more levels of the aforementioned tie-down locations 216 located on the arms 214. The description for how to use these removable ties 218, as well as the installation process, is discussed in additional detail herein with respect to FIG. 3A-3E. In some implementations, the use of removable ties 218 may be obviated in favor of an internal locking mechanism. For example, the arms may be "unlocked" via, for example, physical means such as, for example, the depressing of a button. In other words, the spring-loaded mount arms 214 may be held in their installation configuration via the use of integrated physical locking features and the depressing of the button may cause these physical locking features to disengage from the spring-loaded mount arms 214, thereby causing the arms 214 to swing into their default configuration as-is shown in, for example, FIG. 2.

These arms may be "unlocked" via an electromechanical mechanism in some implementations. For example, a switch may be placed on an external surface of the antenna apparatus 200. This switch may consist of one or more of a toggle switch, a rocker switch, a push-button switch and/or other types of switches that can "make" or "break" an electrical circuit disposed within the antenna apparatus 200. Upon activation of the switch, the aforementioned physical locking features may disengage from the spring-loaded mount arms 214, thereby causing the arms 214 to swing into their default configuration as-is shown in, for example, FIG. 2. In some implementations, a user-operated manual switch may be obviated in favor of electromagnetic signaling which switches the arms from the "locked" to the "unlocked" (default) configuration. The electromagnetic signaling may be received through the antenna apparatus 200 itself, in some implementations. For example, upon receipt of the appropriate electromagnetic signaling, the aforementioned physical locking features may disengage from the spring-loaded mount arms 214, thereby causing the arms 214 to swing into their default configuration. In implementations that may be "locked" or "unlocked", the use of tie-down locations 216 on the arms 214 may be eliminated. However, it may be desirable to include undulations that optimize the electrical length of the arms 214 so as to achieve, for example, a desired radiation pattern characteristic for the exemplary antenna apparatus 200. These and other variants would be readily apparent to one of ordinary skill given the contents of the present disclosure.

As referenced above, the arms 214 may also be biased by other biasing means which may not be "springs" per se. For instance, use of spring steel or other such material may be used without a coiled or helical configuration; e.g., such bending of resilient member. Alternatively, non-metallic biasing components/material may be utilized to cause the arms 214 to be displaced in the desired direction(s) when unconstrained or released, including without limitation elastomers. Shape metal alloys (SMA) may also be utilized to provide desired biasing characteristics, consistent with the present disclosure. For example, an internal electrical circuit may be used to apply current to an SMA filament. The SMA filament may then alter its shape to, for example, an installation configuration or a default configuration. Once current is removed from the SMA filament, the antenna apparatus may revert to its prior configuration (i.e., default configuration or installation configuration).

The antenna apparatus may further consist of a signaling interface 210 (or two or more signaling interfaces 210 for, e.g., MIMO applications). The signaling interface 210 may be configured to transmit signaling from an external cable to the radiating components of the antenna apparatus 200. Additionally, the signaling interface 210 may be configured to receive signaling from the radiating components of the antenna apparatus 200 and provide this received signaling to an external cable. The signaling interface 210 may consist of one of a number of differing design specifications. For example, the signaling interface may consist of an N-female direct mount connector, an N-male direct mount connector. In some implementations, the signaling interface may consist of a New Motorola Mount (NMO) type connection. These NMO type connections may consist of an NMO plus high frequency connector (NMOHF), NMO Pogo Pin connector, direct mount plus N female connector (DMN). The signaling interface 210 may also consist of a so-called pigtail-type connection in some variants. Other suitable connectors for use as the signaling interface 210 would be readily apparent to one of ordinary skill given the contents of the present disclosure.

Figure 2A:
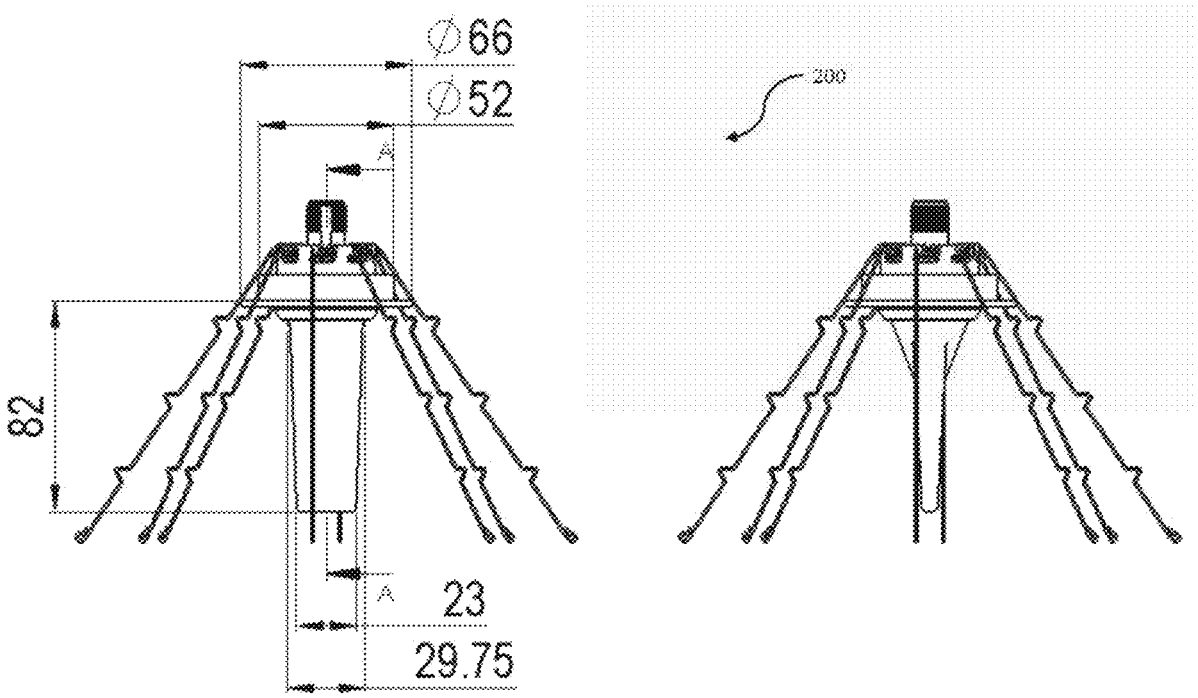
FIG. 2A are front and right-side views of the antenna apparatus of FIG. 2 in accordance with the principles of the present disclosure.
Figure 2B:
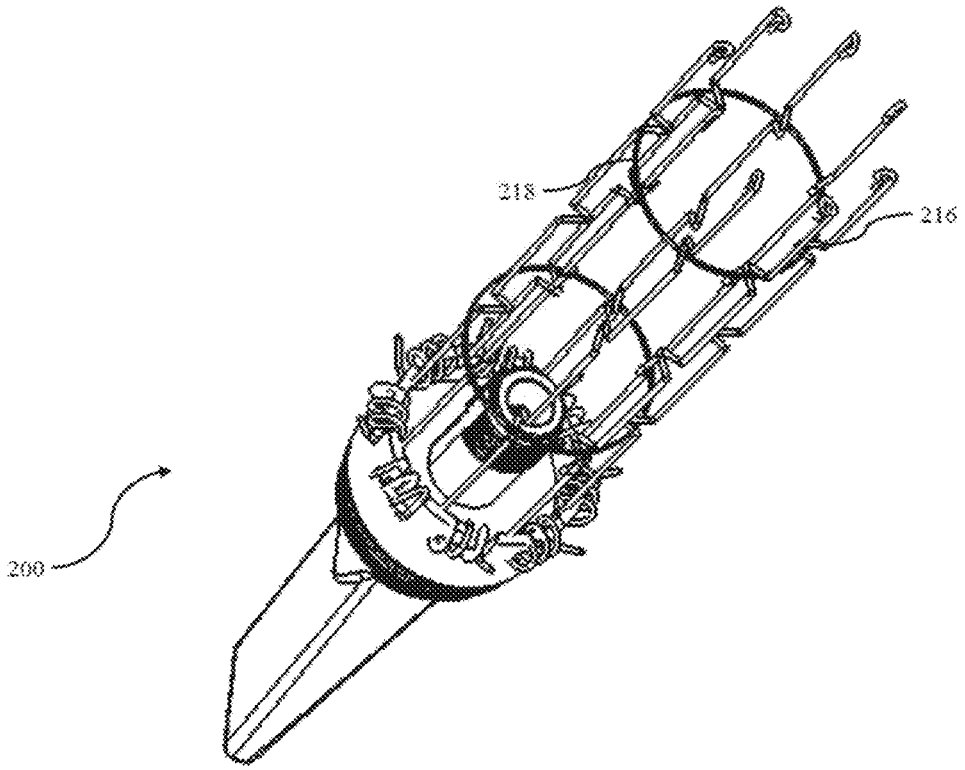
FIG. 2B is a perspective view of the antenna apparatus of FIG. 1 shown in its pre-installation configuration in accordance with the principles of the present disclosure.
Figure 2C:
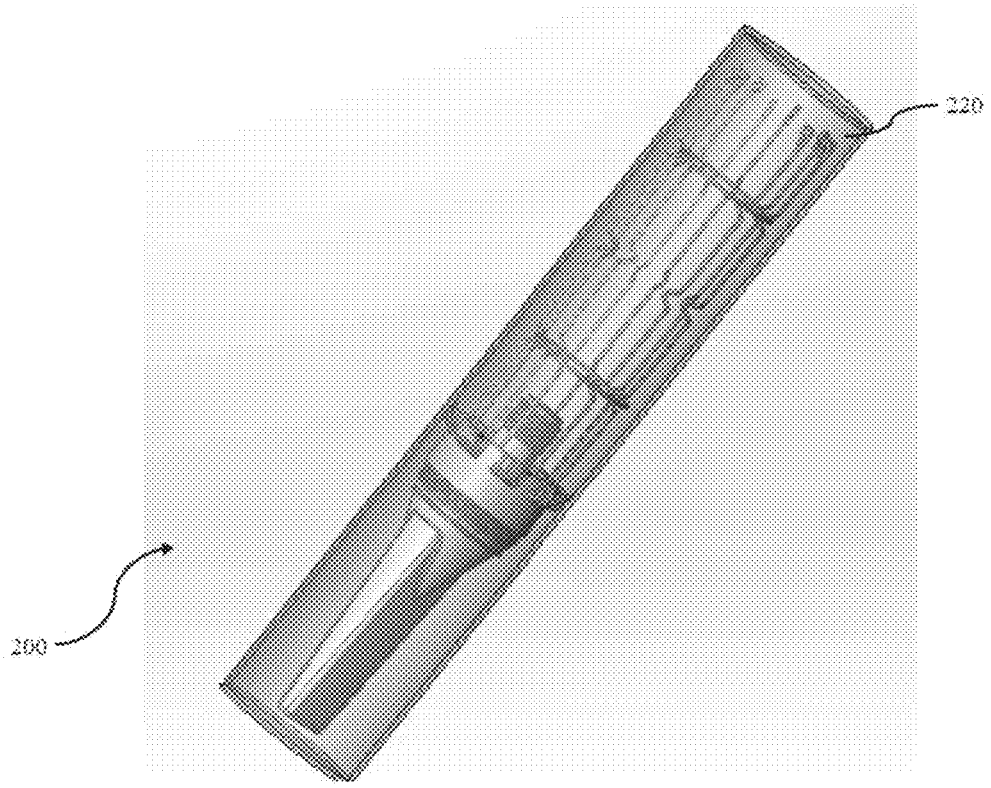
FIG. 2C is a perspective view of the antenna apparatus of FIG. 2B disposed within a shipping module in accordance with the principles of the present disclosure.

FIG. 2A illustrates dimensions in millimeters for one exemplary implementation of the aforementioned antenna apparatus 200, although it would be readily apparent to one of ordinary skill that these dimensions may be suitably modified dependent upon the design specifications for the antenna apparatus 200. FIG. 2C illustrates exemplary packaging 220 for the antenna apparatus 200 in its installation configuration. In the illustrated embodiment, the packaging 220 consists of translucent packaging material in the form of a tube 220, although it is appreciated that non-translucent packaging materials may be substituted with equal success. The tube 220 may consist of a polymer, paper or cardboard, or other suitable types of materials and may be placed into a box (e.g., with other similar type tubes 220) for shipment to, for example, an end customer or consumer. These and other variants would be readily apparent to one of ordinary skill given the contents of the present disclosure. For example, in some implementations, the antenna apparatus 200 may be shipped in its default configuration (e.g., as shown in FIG. 2), as opposed to being shipped in the installation configuration (e.g., as shown in FIG. 2B).

Figure 3A:
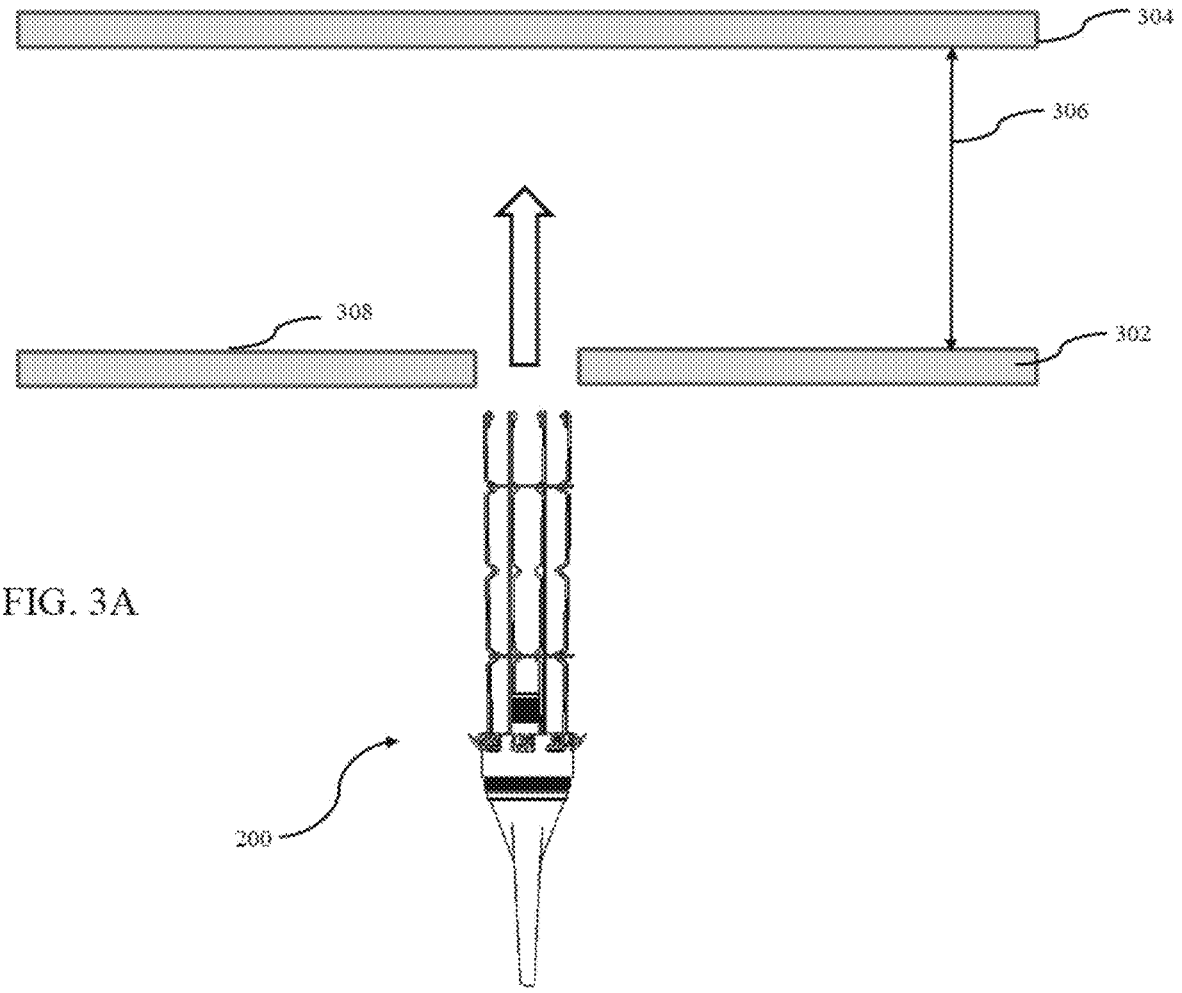
FIG. 3A is a right-side view of the antenna apparatus of FIG. 2B shown prior to installation into, for example, a ceiling tile in accordance with the principles of the present disclosure.

Referring now to FIGS. 3A-3E, an exemplary installation procedure for the antenna apparatus 200 of FIG. 2 is shown and described in detail. While primarily discussed in the context of a ceiling tile installation, it would be readily apparent to one of ordinary skill that the principles of the following discussion have broader applicability to other installation procedures for other structures (e.g., walls, floors and the like). FIG. 3A illustrates an exemplary antenna apparatus 200 shown in its installation configuration. As is well understood in the art, many modern office buildings have ceiling tiles 302 that reside below the actual roof (or floor in a multi-level building) 304. A typical ceiling tile 302 may have a thickness that ranges between twelve point seven and seventeen point five millimeters (12.7 mm-17.5 mm). Additionally, while not illustrated to scale (in FIG. 3A), the installation of the antenna apparatus 200 requires a minimum level of separation 306 between the ceiling tile 302 and the roof (or floor) 304. For example, for an antenna apparatus 200 having the dimensions as illustrated in FIG. 2A, the minimum separation 306 should be on the order of about 140 mm. It will be appreciated, however, that different form factors of the antenna apparatus 200 may be used depending on the available "backing" dimension or separation 306 available for a particular installation. For instance, the present disclosure contemplates a "low profile" variant of the apparatus 200, such that the backing space requirements are reduced over those of the illustrated embodiment. In one such variant, multi-segment arms are utilized such that each arm, under biasing force, "unfolds" in two or more motions or steps, such that the total height or space 306 required is less than that of deployment of a single-segment arm 214. Moreover, the present disclosure contemplates substantially radial deployment of the arms 214, such as radially outward from a longitudinal axis (not shown) of the antenna apparatus (e.g., such as where the arms are telescoping in nature), or spirally from said axis (e.g., in a "pinwheel" pattern). Prior to installation of the antenna apparatus 200, a hole 308 needs to be drilled (or cut) into the ceiling tile 302. The hole 308 should be larger in diameter than the diameter of the antenna housing 204, but smaller in diameter than the diameter of the lower flange 206. For example, for an antenna apparatus 200 having the dimensions as illustrated in FIG. 2A, the hole 308 may have a diameter of about fifty-four millimeters (54 mm). Note that unlike prior installation techniques, this hole 308 may be drilled (or cut) without necessitating the removal of the ceiling tile 302.

Figure 3B:
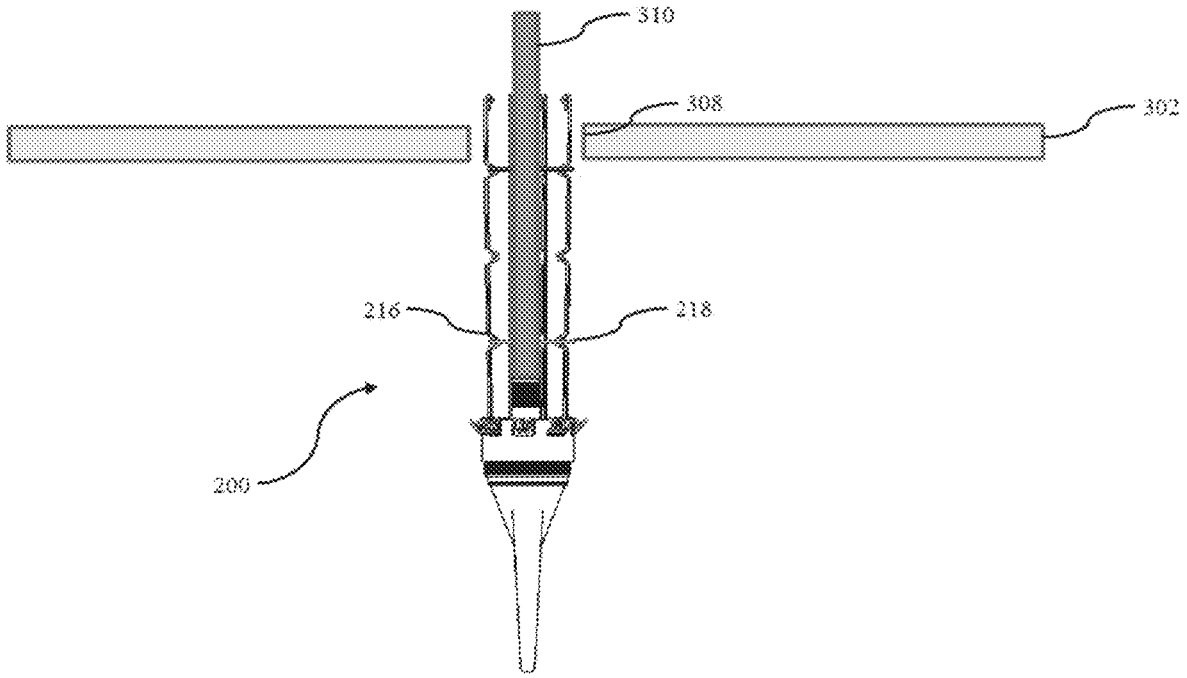
FIG. 3B is a right-side view of the antenna apparatus of FIG. 3A subsequent to the installation of an antenna cable in accordance with the principles of the present disclosure.

Referring now to FIG. 3B, the next step of the installation process requires the attachment of an external cable 310 that is resident above the ceiling tile 302 to the antenna apparatus 200 (specifically to the signaling interface 210 of the antenna apparatus 200). The arms 214 of the antenna apparatus 200 are then placed partially into the hole 308. The removable ties 218 are then removed from the tie-down locations 216. In some implementations, the removable ties 218 are simply cut in order to remove them from the antenna apparatus 200. In other implementations, the removable ties 218 may be twisted together (i.e., they are similar to twist ties). Accordingly, the removable ties 218 may be removed by untwisting the twisted removable ties 218. In implementations in which the spring-loaded mount apparatus 208 is operated without the use of the removable ties 218 (e.g., using the aforementioned physical or electromagnetic mechanisms described supra), the antenna apparatus 200 may be partially (or fully) inserted into the hole 308 and the spring-loaded mount apparatus 208 may change the antenna apparatus 200 from the installation configuration to the default configuration (or part way thereto).

Figure 3C:
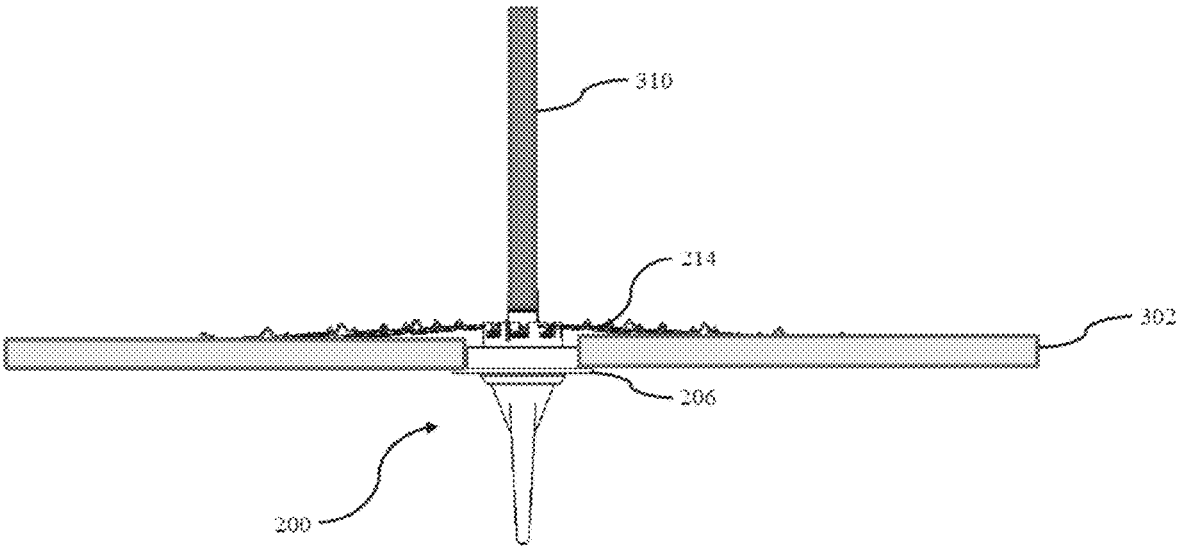
FIG. 3C is a right-side view of the antenna apparatus of FIG. 3A subsequent to the installation of the antenna apparatus into, for example, a ceiling tile in accordance with the principles of the present disclosure.
Figure 3D:
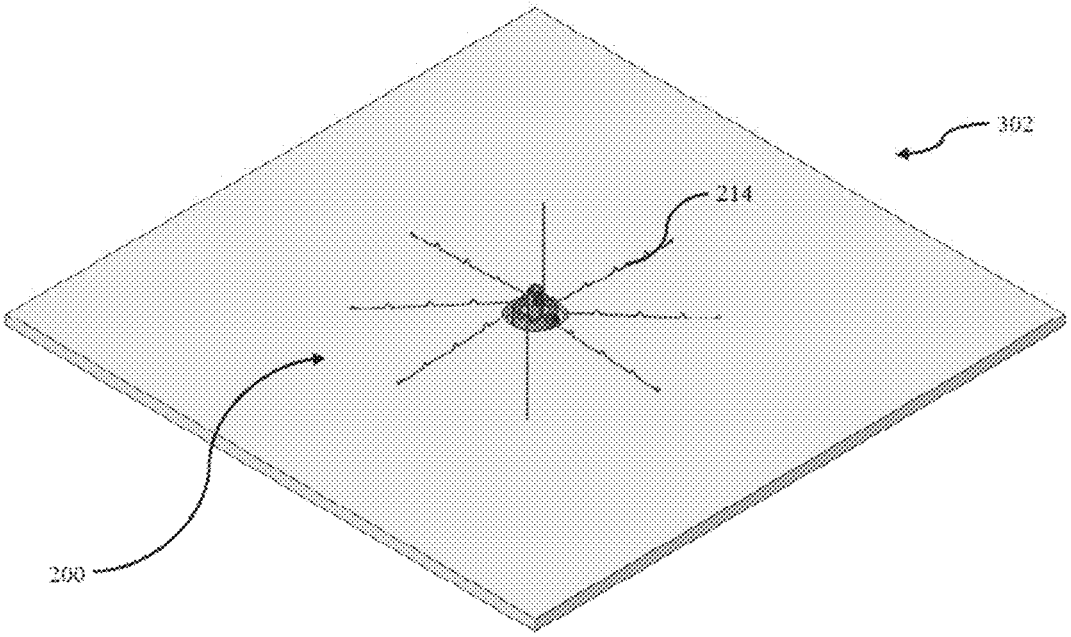
FIG. 3D is a perspective view of the antenna apparatus of FIG. 3C showing the back-side of the antenna apparatus installation in accordance with the principles of the present disclosure.
Figure 3E:
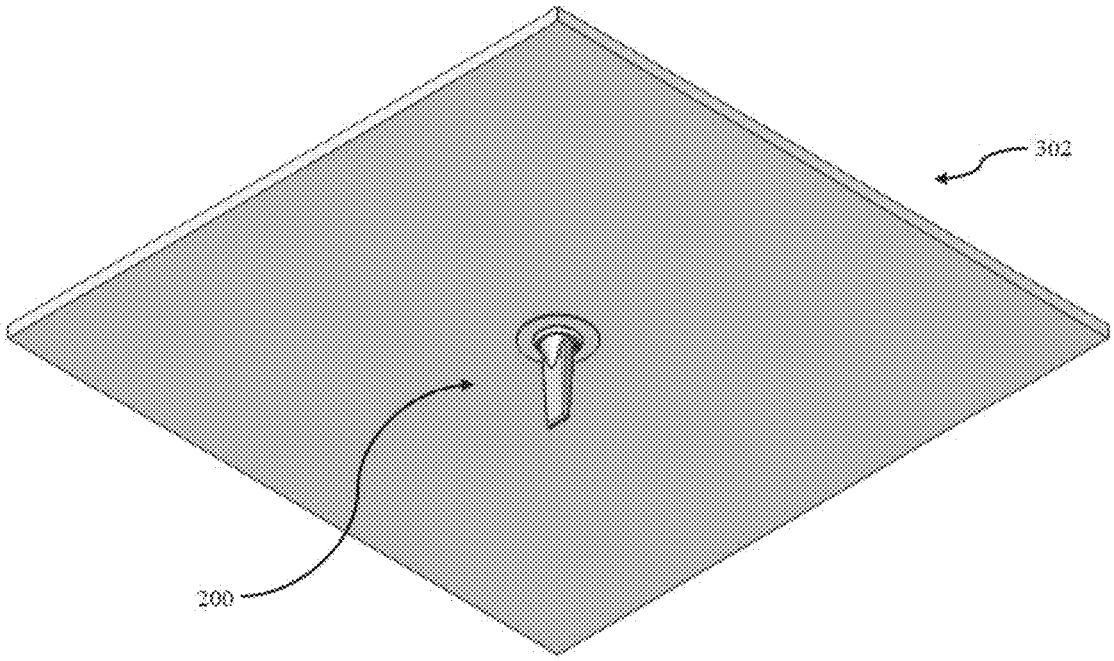
FIG. 3E is a perspective view of the antenna apparatus of FIG. 3C showing the front-side of the antenna apparatus installation in accordance with the principles of the present disclosure.

It may be desirable to only partially insert the antenna apparatus 200 into the hole 308 so as to prevent damage to the ceiling tile 302 during spring-loaded actuation. In other words, due to the constraints of the dimension of the hole 308, the arms may fold out slower as the antenna apparatus is inserted (and/or pulled) into the hole 308, thereby preventing excessive forces caused by the torsion springs 212 to be applied to the top surface of the ceiling tile 302. The antenna apparatus 200 is pulled (via the attached external cable 310) and/or pushed into the hole 308 until the top surface of the lower flange 206 is placed into contact with the bottom surface of the ceiling tile 302 as shown in FIG. 3C. Note that the antenna apparatus 200 is held in place via the exertion of force by the arms 214 of the antenna apparatus 200. The exerted force may take into consideration, for example, the underlying size and/or weight of the antenna apparatus 200. For example, for relatively small and/or lightweight antenna designs, less exerted force may be acceptable, while for relatively large and/or heavier antenna designs, more exerted force may be required. In this manner, the antenna apparatus 200 may be secured to the ceiling tile 302 without requiring removal of the ceiling tile 302 from the ceiling. FIG. 3D illustrates the installed antenna apparatus 200 from the back-side, while FIG. 3E illustrates the installed antenna apparatus 200 as it would be viewed by someone located in the room in which the antenna apparatus 200 has been installed.

Exemplary Installation Methodologies—

Figure 4:
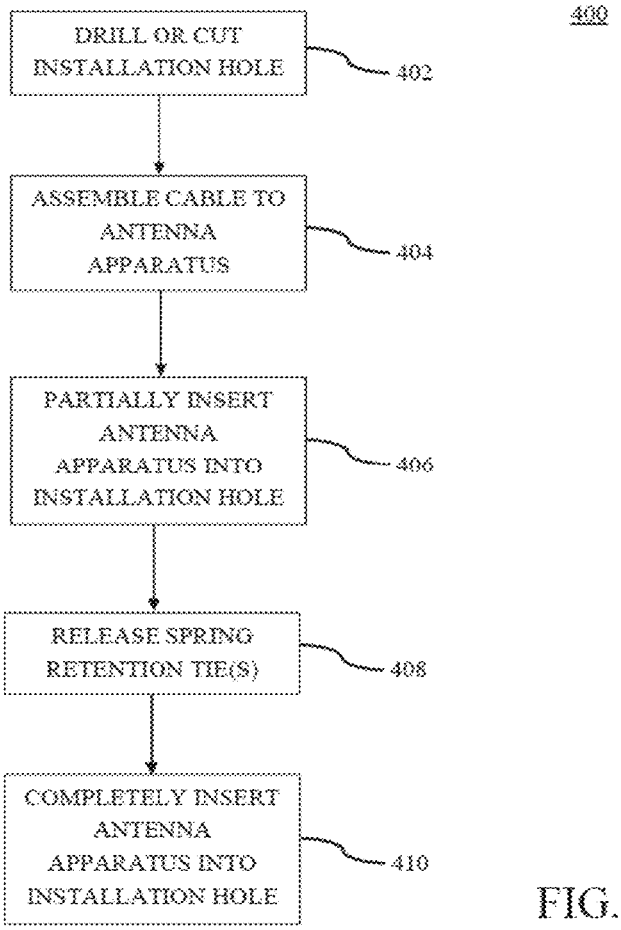
FIG. 4 is a logical flow diagram illustrating an exemplary method for installing the antenna apparatus of FIG. 2 in accordance with the principles of the present disclosure.

Referring now to FIG. 4, an exemplary methodology 400 for the installation of an antenna apparatus (such as antenna apparatus 200) is shown and described in detail. At operation 402, an installation hole is drilled or cut into the surface (e.g., a ceiling) to which the antenna apparatus is to be mounted. At operation 404, a cable assembly that is received through the installation hole is assembled to the antenna apparatus. At operation 406, the antenna apparatus is partially inserted into the installation hole, and the spring retention tie(s) are released or relaxed (e.g., cut) at operation 408. At operation 410, the antenna apparatus is completely inserted into the installation hole. In some implementation, this complete insertion is accomplished via the pulling of the cable assembly. In other implementations, this complete insertion is accomplished via the pushing of the antenna assembly into the installation hole. In yet other implementations, this complete insertion is accomplished via a combination of the foregoing (e.g., a pulling of the cable assembly along with a simultaneous (or near simultaneous) pushing of the antenna assembly into the installation hole.

It will be recognized that while certain aspects of the present disclosure are described in terms of specific design examples, these descriptions are only illustrative of the broader methods of the disclosure, and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure described and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the principles of the present disclosure. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

What is claimed is:

1. An antenna apparatus, the antenna apparatus comprising:

a radome cover at least partly enclosing at least one antenna element;

a flange disposed adjacent to the radome cover;

an antenna housing, the flange being disposed between the radome cover and the antenna housing;

a signaling interface; and a spring-loaded mount apparatus comprising both a mechanical and an electrical function, the electrical function comprising a ground plane for the antenna apparatus, the spring-loaded mount apparatus further comprising:

a housing, a plurality of torsion springs located in or on the housing; and a plurality of spring arms, each of the plurality of spring arms being coupled with one or more of the plurality of torsion springs, each of the plurality of spring arms comprising a plurality of undulations, the plurality of undulations increasing an electrical length for the ground plane as compared with a spring arm that does not include the plurality of undulations.

2. The antenna apparatus of claim 1, wherein the plurality of torsion springs are configured to place the plurality of spring arms against the flange.

3. The antenna apparatus of claim 1, wherein the plurality of spring arms each comprise at least one tie down location, the at least one tie down location configured to be used with a tie down in order to place the spring-loaded mount apparatus into an installation configuration.

4. The antenna apparatus of claim 3, wherein:

the plurality of spring arms are configured to be in at least a first configuration or a second configuration;

in the first configuration, the spring-loaded mount apparatus is in the installation configuration, the installation configuration allowing the spring-loaded mount apparatus to at least partially pass through an installation surface;

in the second configuration, the plurality of spring arms abut a first side of the installation surface, and the flange abuts a second side of the installation surface.

5. The antenna apparatus of claim 1, wherein the at least one antenna element comprises a quarter wave monopole antenna, the quarter wave monopole antenna being disposed within the radome cover.

6. The antenna apparatus of claim 5, wherein the ground plane for the antenna apparatus is configured such that a radiating pattern for the quarter wave monopole antenna is omnidirectional in nature, the radiating pattern being further directed away from the ground plane of the antenna apparatus.

7. An antenna apparatus comprising:

a radome with at least one antenna element disposed at least partly therein;

a flange proximate the radome, the flange configured to abut against a first side of an installation surface; and a plurality of spring apparatus configured to abut against a second side of the installation surface and to facilitate the abutting of the flange against the first side;

wherein:

the plurality of spring apparatus each comprises a physical configuration selected so as to cause emission by the at least one antenna element of a radiation pattern directed away from the installation surface; and each of the plurality of spring apparatus is configured to have a physically locked state and a physically unlocked state, the locked state configured to be maintained by one or more physical locking features, the unlocked state being accessible via an electromechanical mechanism, the electromechanical mechanism configured to disengage the one or more physical locking features.

8. The antenna apparatus of claim 7, wherein the at least one antenna element is electrically coupled to at least a portion of the plurality of spring apparatus, and further comprises:

a signaling interface configured to transmit signals between a source and the at least one antenna element;

wherein the plurality of spring apparatus are further configured to provide ground plane functionality.

9. The antenna apparatus of claim 7, wherein the at least one antenna element comprises a monopole antenna, and the monopole antenna is disposed at least partly within the radome.

10. The antenna apparatus of claim 7, wherein the radiation pattern comprises an omnidirectional pattern that is directed away from the plurality of spring apparatus.

11. The antenna apparatus of claim 10, wherein the omnidirectional pattern comprises a direction parallel to the installation surface and a direction away from the installation surface.

12. The antenna apparatus of claim 7, wherein at least one of the plurality of spring apparatus comprises one or more indentations, the one or more indentations of the at least one spring apparatus configured to achieve at least a prescribed electrical length, and to be consistent with the radiation pattern.

13. The antenna apparatus of claim 7, wherein the physically locked state is configured to enable the plurality of spring apparatus to pass through an opening associated with the installation surface, the opening having a dimension smaller than that of the flange; and the physically unlocked state is configured to prevent the plurality of spring apparatus from passing through the opening, the physically unlocked state comprising the flange abutting the first side of the installation surface, and the plurality of spring apparatus abutting the second side of the installation surface.

14. An antenna apparatus comprising:

a radome with at least one antenna element disposed at least partly therein;

a flange proximate the radome, the flange configured to abut against a first side of an installation surface; and a plurality of spring apparatus configured to abut against a second side of the installation surface and to facilitate the abutting of the flange against the first side;

wherein:

the plurality of spring apparatus each comprises a physical configuration selected so as to cause emission by the at least one antenna element of a radiation pattern directed away from the installation surface; and at least one of the plurality of spring apparatus comprises one or more indentations, the one or more indentations of the at least one spring apparatus configured to achieve at least a prescribed electrical length, and further configured to be consistent with the radiation pattern.

15. The antenna apparatus of claim 14, wherein the at least one antenna element is electrically coupled to at least a portion of the plurality of spring apparatus, and further comprises:

a signaling interface configured to transmit signals between a source and the at least one antenna element;

wherein the plurality of spring apparatus are further configured to provide ground plane functionality.

16. The antenna apparatus of claim 14, wherein the at least one antenna element comprises a monopole antenna, and the monopole antenna is disposed at least partly within the radome.

17. The antenna apparatus of claim 14, wherein the radiation pattern comprises an omnidirectional pattern that is directed away from the plurality of spring apparatus.

18. The antenna apparatus of claim 17, wherein the omnidirectional pattern comprises radiation that extends in a direction parallel to the installation surface and away from the installation surface.

19. The antenna apparatus of claim 14, wherein each of the plurality of spring apparatus is configured to have a physically locked state and a physically unlocked state, the locked state configured to be maintained by one or more physical locking features, the unlocked state being accessible via an electromechanical mechanism, the electromechanical mechanism configured to disengage the one or more physical locking features.

20. The antenna apparatus of claim 19, wherein the physically unlocked state is configured to enable the plurality of spring apparatus to pass through an opening of the installation surface prior to the abutting against the second side of the installation surface.

* * * * *